US005715910A

United States Patent [19]

Koch et al.

[11] Patent Number: 5,715,910

[45] Date of Patent: Feb. 10, 1998

[54] STAIRWAY PLATFORM

[76] Inventors: Michael W. Koch; Lynette K. Koch, both of 2505 Kennelly Pl., Burnsville, Minn. 55337

[21] Appl. No.: 504,998

[22] Filed: Jul. 20, 1995

[51] Int. Cl.[6] ..... E04C 3/00

[52] U.S. Cl. ..... 182/200; 182/33

[58] Field of Search ..... 182/200, 107, 182/222, 33; 248/188.2; D6/349

[56] References Cited

U.S. PATENT DOCUMENTS

| | | | |
|---|---|---|---|
| D. 271,256 | 11/1983 | McClelland | D6/349 |
| 1,057,722 | 4/1913 | Goetz . | |
| 1,095,945 | 5/1914 | Tellander | 182/107 |
| 1,325,423 | 12/1919 | Stuart . | |
| 1,474,250 | 11/1923 | Folliard . | |
| 2,044,703 | 6/1936 | Kline . | |
| 2,556,611 | 6/1951 | Borgman . | |
| 3,554,318 | 1/1971 | Knight . | |
| 4,457,397 | 7/1984 | Scala . | |
| 5,263,551 | 11/1993 | Anderson | 182/107 X |

OTHER PUBLICATIONS

Photograph #1.
Photograph #2.
Photograph #3.
Photograph #4.
Photograph #5.
Photograph #6.
Photograph #7.

*Primary Examiner*—Alvin C. Chin-Shue
*Attorney, Agent, or Firm*—Palmatier, Sjoquist, Helget & Voigt, P.A.

[57] ABSTRACT

This invention relates to a stairway platform device which is used upon a stairway to provide a stable base to assist an individual in reaching the highest portions of a wall during painting and/or wallpapering activities. The stairway platform device generally includes a platform, a front support wall which may include a retractable tuck-under leg, a rear support wall which may include a handle and/or a storage compartment, and a pair of side support walls; each side support wall including a plurality of step engagement edges and riser engagement edges. The side support walls, front support wall, and rear support wall preferably depend and are flared outwardly from the platform. Each of the side support walls, front support wall, and rear support wall may additionally include flanges which may be utilized to assist in the stacking and storage of a plurality of stairway platform devices during periods of non-use.

21 Claims, 13 Drawing Sheets

STAIRWAY PLATFORM

BACKGROUND OF THE INVENTION

The stairway platform invention relates to a convenient device which may be utilized to level a working or support surface upon a stairway.

In the past, individuals engaging in painting or wallpapering activities in areas adjacent stairways have utilized various unsafe devices to attempt to provide a working surface. Many individuals use blocks, telephone books, encyclopedias, dictionaries, and/or other materials in order to provide a working surface to support themselves or a ladder upon a stairway. These types of devices are very unstable which frequently cause, or expose the individual to a significant risk, of injury. Alternatively, an individual is required to transport heavy, inconvenient, and cumbersome scaffolding into a stairway area in order to provide a relatively safe working or support surface. The use of scaffolding in a stairway area is quite inconvenient and time consuming, resulting in a significant time loss to an individual in order to obtain a safe working environment.

Normally stairs in residential buildings have a horizontal step portion having a dimension of approximately ten and one-half inches, and a vertical riser portion having a dimension of approximately seven and one-half inches. Frequently, stairways are carpeted which emphasizes the overlap of the leading edge of a horizontal step portion as related angularly to the vertical riser portion of the preceding step. In the past, no stairway platform device was known which fully engaged the surface of a horizontal step portion. The known devices were adversely affected by the overlap of the horizontal step portion relative to the vertical riser portion. As such, the available surface area to be utilized by a stairway platform device was reduced, which in turn, adversely affected the stability of the working or support surface. A stairway platform device is needed to maximize utilization of the horizontal step surface of a stairway to improve the stability of a working surface.

SUMMARY OF THE INVENTION

This invention relates to a stairway platform device which is used upon a stairway to provide a stable base to assist an individual in reaching the highest portions of a wall during painting and/or wallpapering activities. The stairway platform device generally includes a platform, a front support wall which may include a retractable tuck-under leg, a rear support wall which may include a handle and/or a storage compartment, and a pair of side support walls; each side support wall including a plurality of step engagement edges and riser engagement edges. The side support walls, front support wall, and rear support wall preferably depend and are flared outwardly from the platform. Each of the side support walls, front support wall, and rear support wall may additionally include flanges which may be utilized to assist in the stacking and storage of a plurality of stairway platform devices during periods of non-use.

It is a principle object of the present invention to provide a new and improved stairway platform of relatively simple and inexpensive design, construction, and operation which is safe and durable and which fulfills the intended purpose without fear of injury to persons and/or damage to property.

It is another object of the present invention to provide a stairway platform device of improved strength and stability which maximizes utilization of the horizontal step surface of a stairway.

It is still another object of the present invention to provide a stairway platform device which may be safely used by an individual as a support surface for a ladder during wallpapering or painting activities.

It is still another object of the present invention to provide a stairway platform device which is flexible and may be additionally used as a stool by an individual.

It is still another object of the present invention to provide a stairway platform device which may be utilized as a carrier of wallpapering or painting tools by an individual.

It is still another object of the present invention to provide a level working surface adjacent the steps of a building during the performance of work related to painting, wallpapering, or picture hanging activities.

It is still another object of the present invention to provide a stairway platform device which may be easily and conveniently moved from step to step during performance of painting or wallpapering activities.

A feature of the present invention is a platform surface having a plurality of ribs which minimize the risk of slippage of a ladder or an individual during wallpapering or painting activities.

Another feature of the present invention is a pair of side support walls which depend and are outwardly flared from the platform in order to maximize the strength and stability of the invention.

Still another feature of the present invention is the provision of a front support wall and a rear support wall which depend and are flared outwardly from the platform which enable a plurality of stairway platform devices to be conveniently stacked during periods of non-use.

Still another feature of the present invention is the provision of a plurality of horizontal step engagement edges and a plurality of vertical riser engagement edges which maximize the contact area of the stairway platform device when positioned upon a set of stairs.

Still another feature of the present invention is the provision of flanges upon the platform, the side support walls, front support wall, and rear support wall, which assist in the stacking of a plurality of stairway platform devices.

Still another feature of the present invention is the provision of a handle to assist in the convenient transportation of the stairway platform device by an individual.

Still another feature of the present invention is a storage compartment accessible through the rear support wall which enables an individual to conveniently transport painting or wallpapering tools.

Still another feature of the present invention is the provision of a pivotable and retractable tuck-under leg which is engaged proximate to the front support wall which enables the stairway platform device to be utilized as a stool by an individual.

Still another feature of the present invention is the provision of approximately eight square feet of level working space to be utilized by an individual during painting or wallpapering activities.

DETAILED DESCRIPTION OF THE PREFERRED EMBODIMENTS

Figure 1:
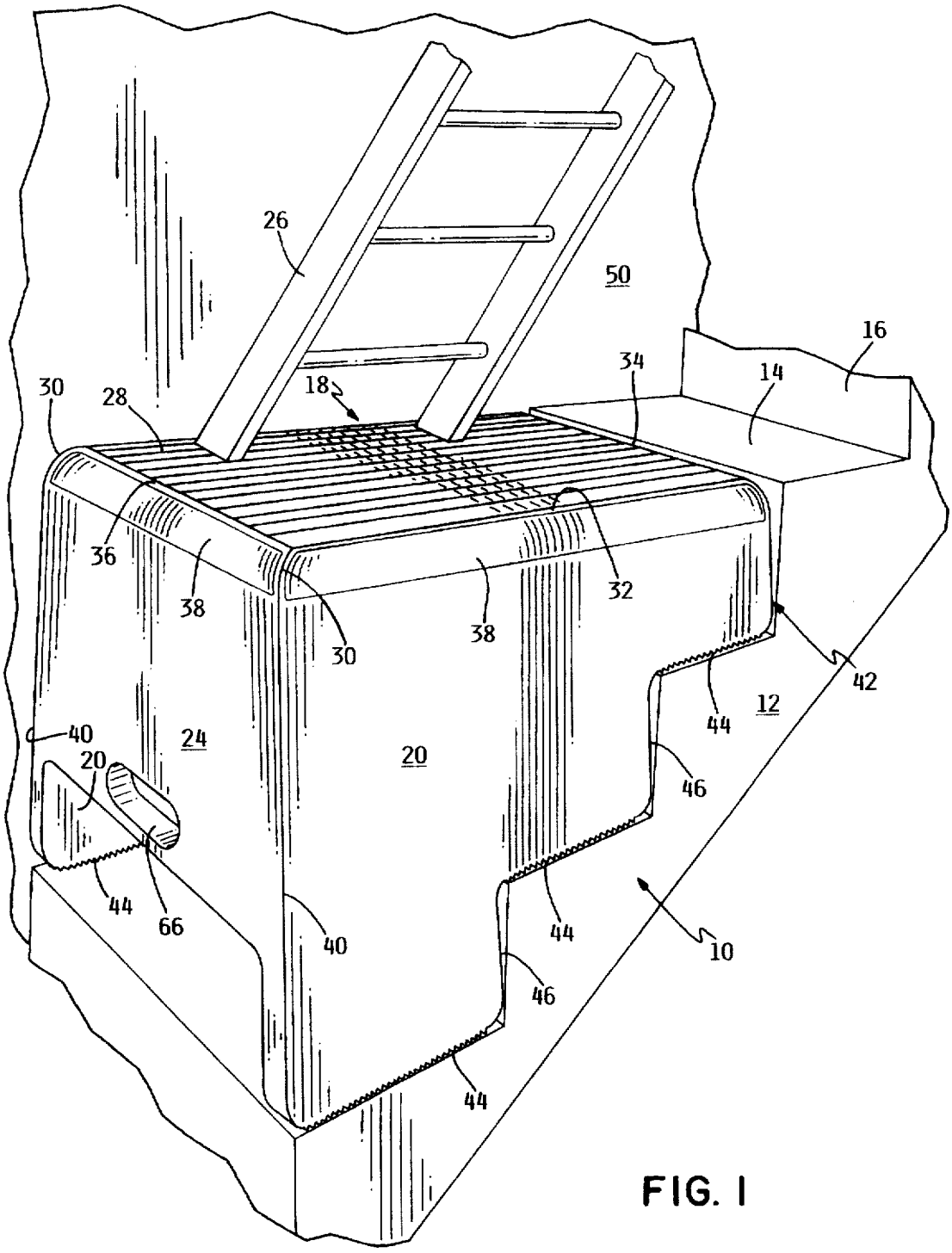
FIG. 1 is an environmental view of the stairway platform device positioned on a stairway while simultaneously supporting a ladder.
Figure 2:
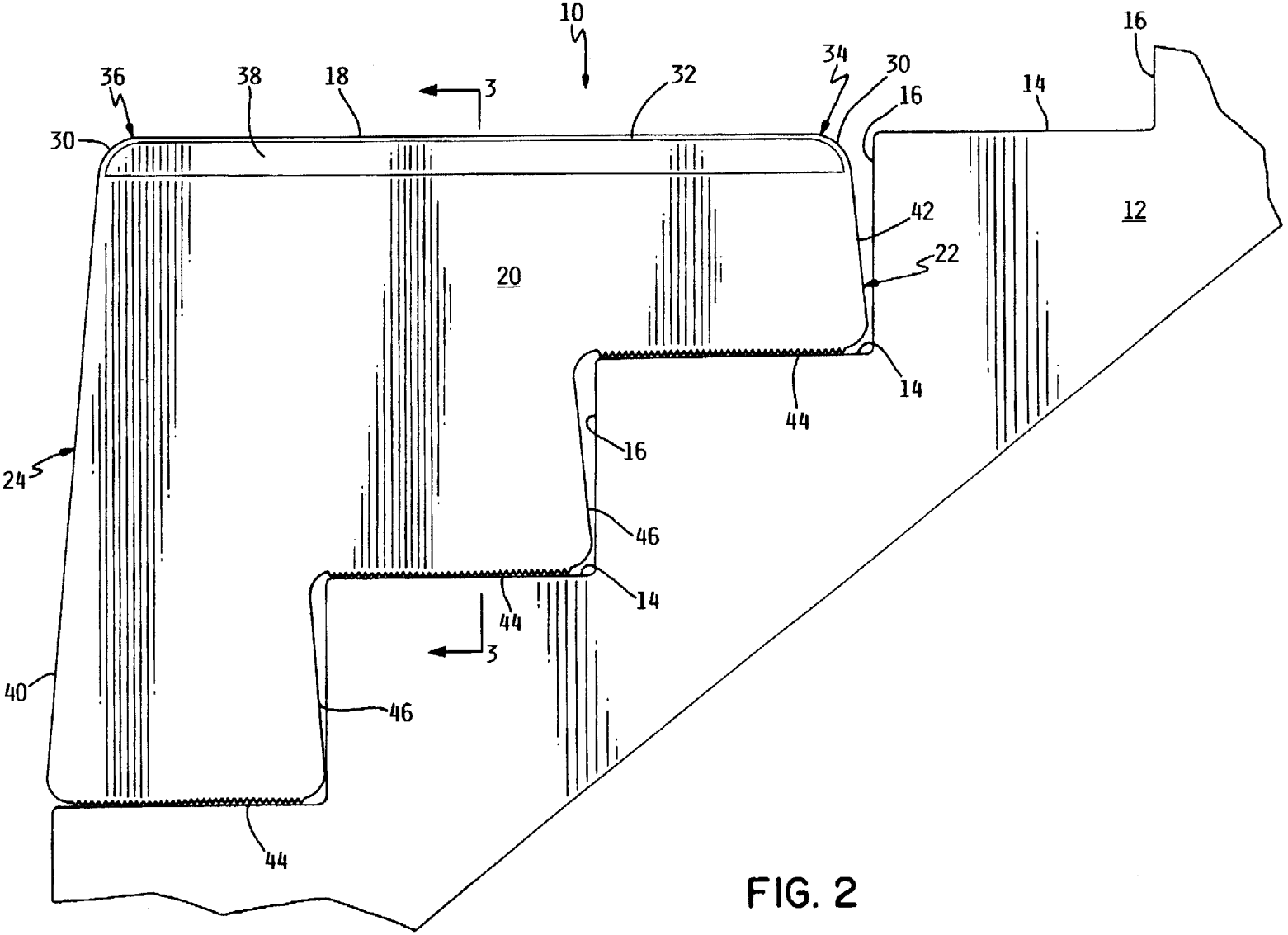
FIG. 2 is a side environmental view of the stairway platform device/positioned on a stairway.
Figure 3:
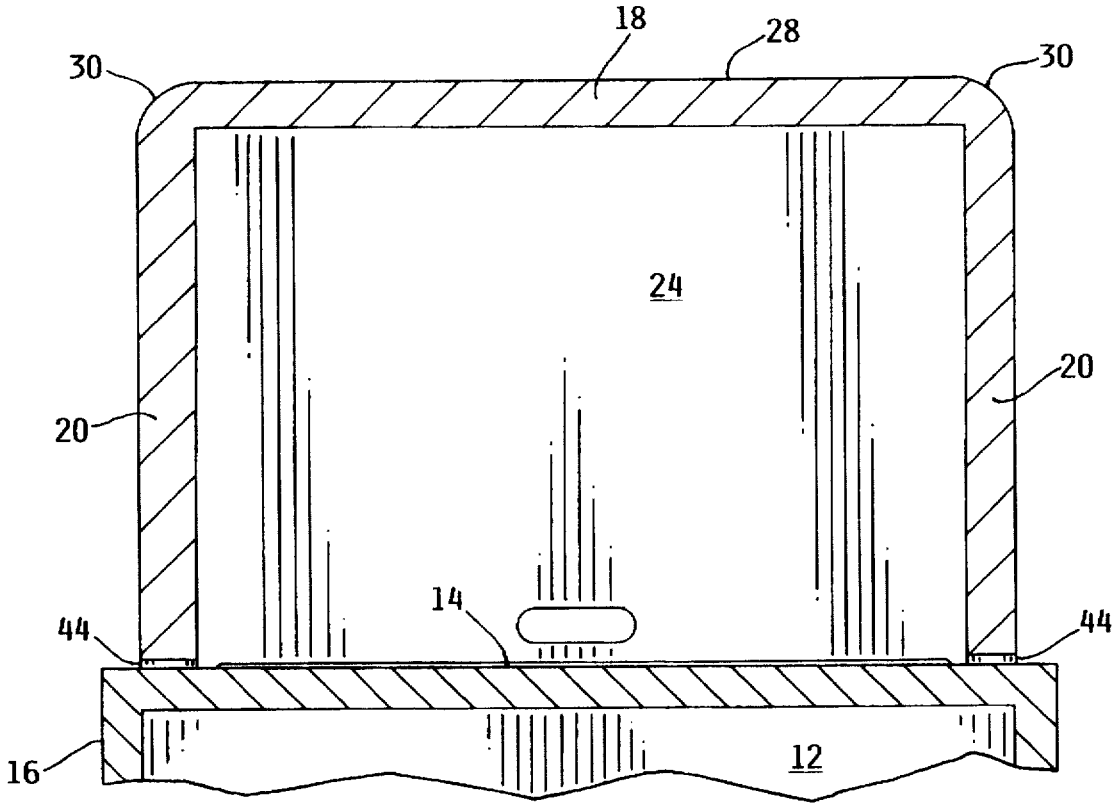
FIG. 3 is a cross-sectional end view of the stairway platform device taken along the line of 3—3 of FIG. 2.
Figure 4:
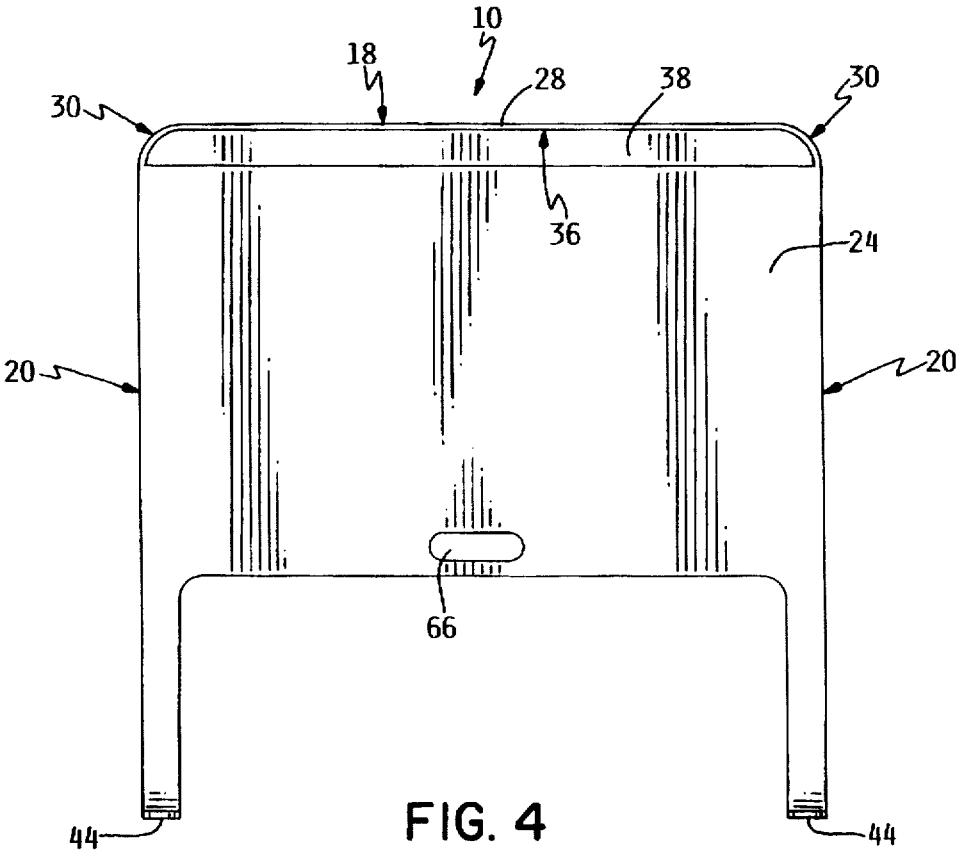
FIG. 4 is an alternative rear view of the stairway platform device.
Figure 5:
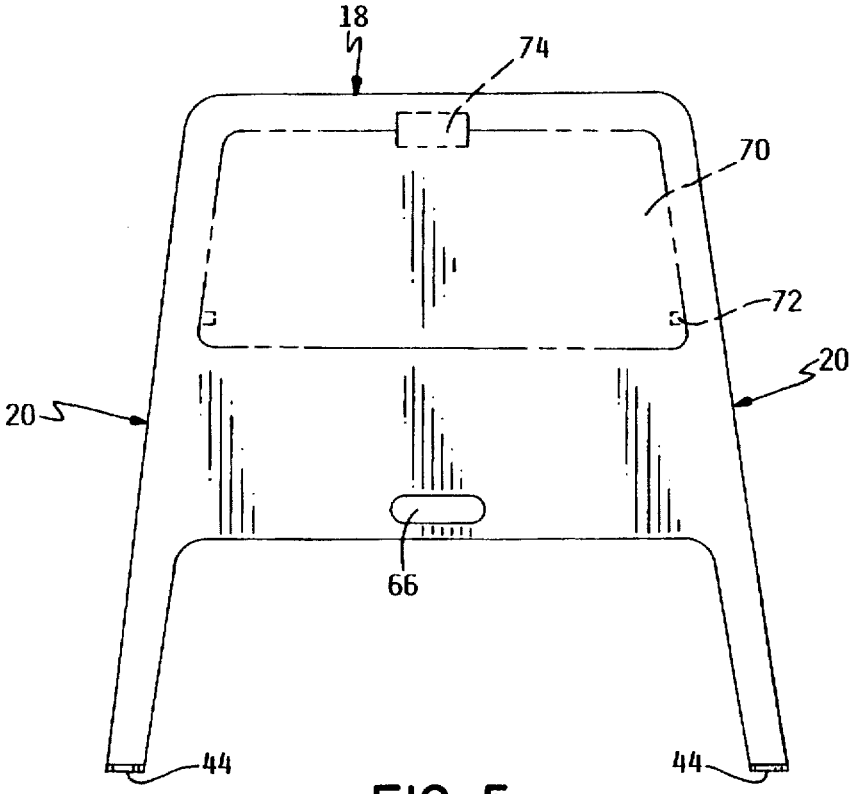
FIG. 5 is an alternative rear view of the stairway platform device showing the storage compartment in phantom line.
Figure 6:
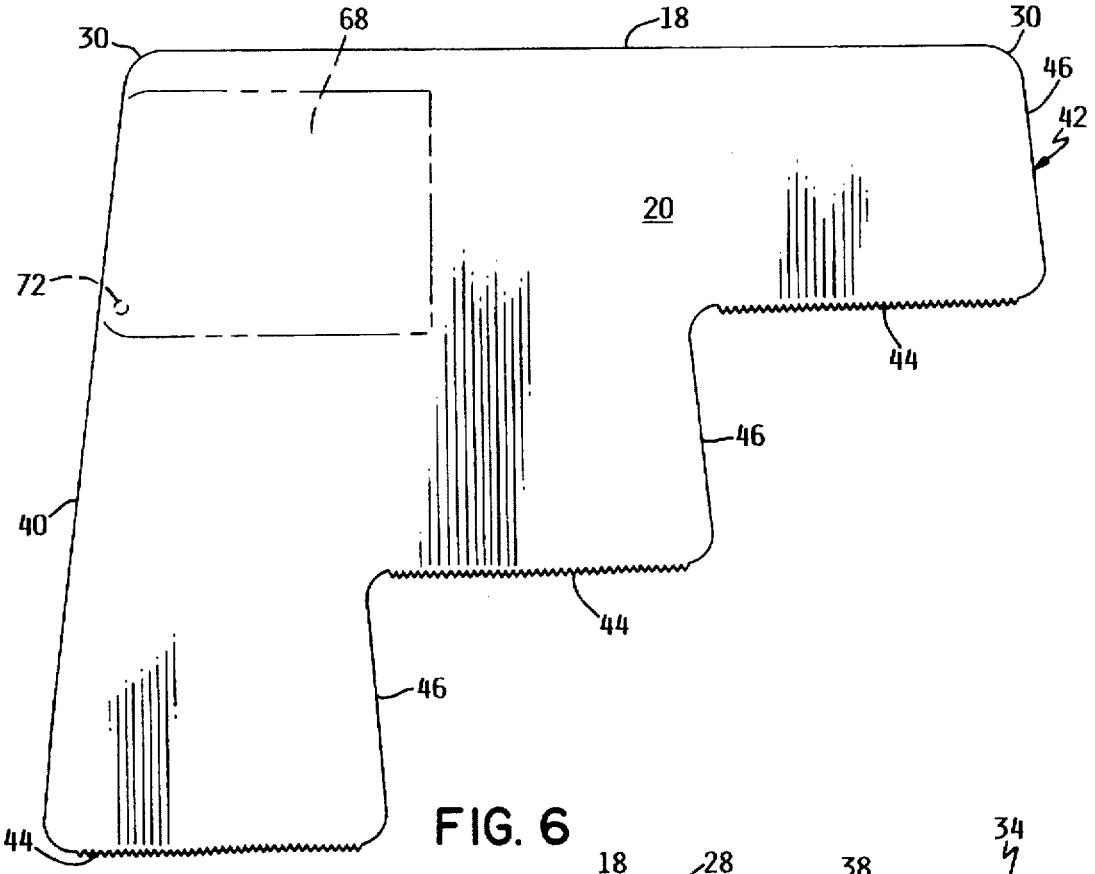
FIG. 6 is an alternative side view of the stairway platform device showing the storage compartment in phantom line.
Figure 7:
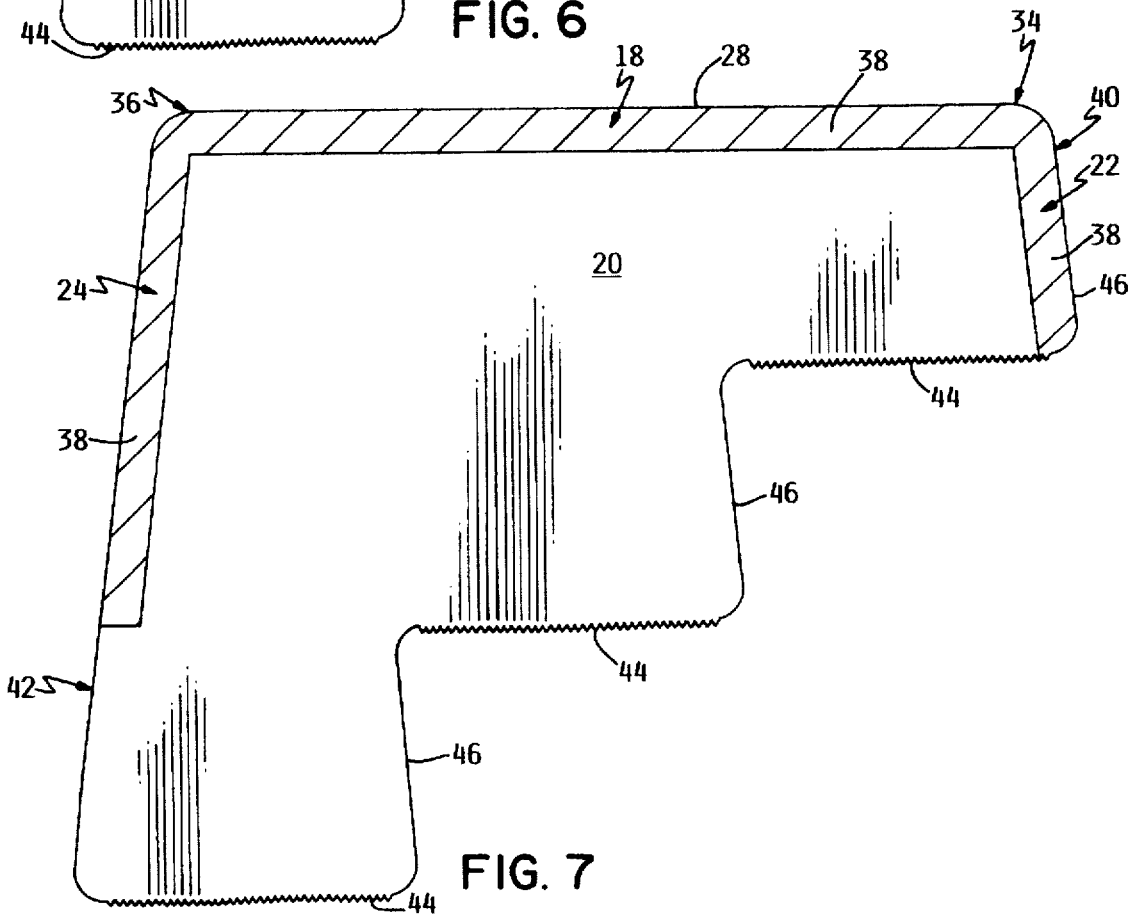
FIG. 7 is a cross-sectional alternative side view of the stairway platform device taken along the line of 7—7 of FIG. 4.

One form of the invention is illustrated and described herein. In general, the stairway platform device is indicated by the numeral 10. The stairway platform device 10 is preferably used in conjunction with the stairs 12 of a residential building. As may be seen in FIGS. 1 and 2, the stairs 12 are preferably formed of a generally flat horizontal surface 14 and a vertical riser surface 16. In general, the stairway platform device 10 is formed of a platform 18, a pair of side support walls 20, a front support wall 22, and a rear support wall 24. (FIGS. 1 and 2).

The stairway platform device 10 may be used as a stepping platform by an individual or may be used as a support surface for a ladder 26 at the preference of an individual during wallpapering, painting, or picture hanging activities. The stairway platform device 10 may be preferably formed of plastic, aluminum, fiberglass, or composite wood material, or any combination of standard accepted construction materials at the preference of an individual.

Figure 12:
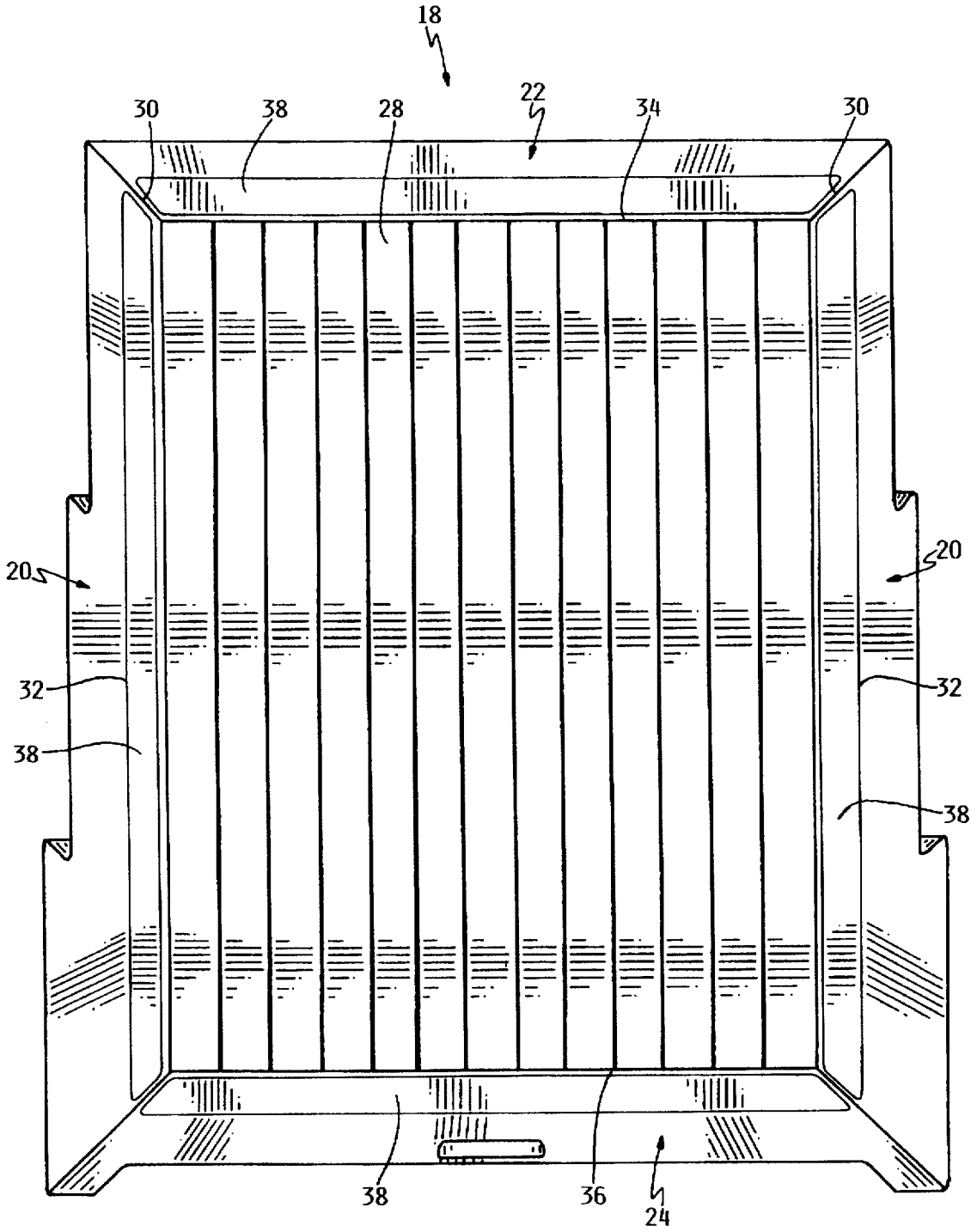
FIG 12 is a top view of the stairway platform device.
Figure 13:
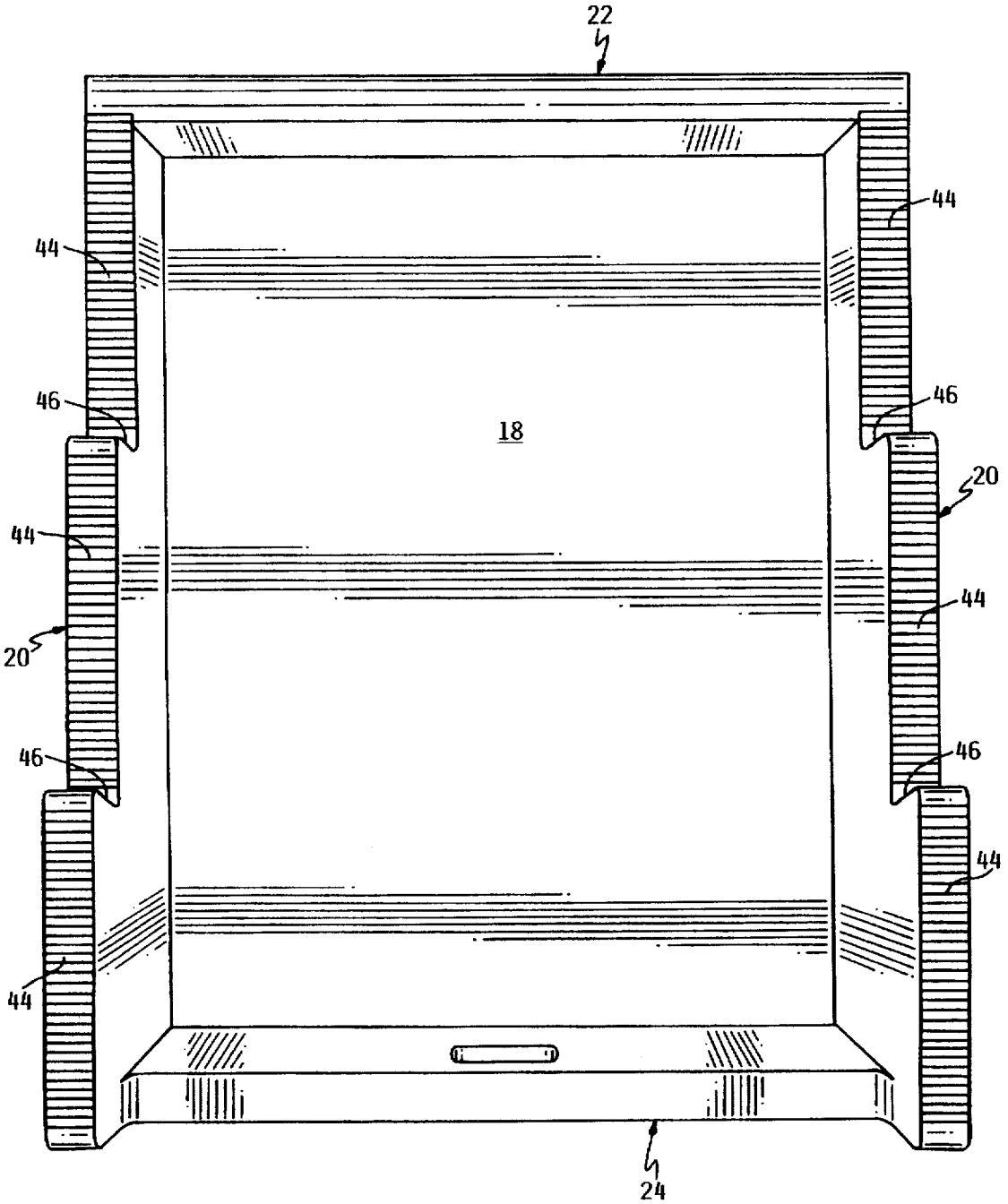
FIG. 13 is a bottom view of the stairway platform device.

The platform 18 preferably includes a substantially flat and horizontal surface 28 which includes a slip resistant surface which may be formed of a plurality of substantially parallel and regularly spaced ribs. The slip resistant or ribbed surface 28 may be preferably formed of a plastic or rubber material at the discretion of an individual. The slip resistant surface 28 of the platform 18 preferably enhances the safety of the stairway platform device 10 by minimizing the slippage of an individual's feet or the base of a ladder during wallpapering, painting, or picture hanging activities. The slip resistant surface 28 may be formed of a one-eighth inch mat at the preference of an individual. (FIG. 12)

The platform 18 is preferably substantially rectangular, however, the platform 18 may be substantially square or oval in shape at the discretion of an individual. The platform 18 may include rounded corners 30 at the preference of an individual.

In the preferred embodiment, the platform 18 is formed of a pair of substantially parallel and elongate side edges 32, a front edge 34, and a rear edge 36. The pair of substantially parallel and elongate side edges 32, front edge 34 and rear edge 36 establish a periphery about the platform 18. A flange 38 may be incorporated into the substantially parallel and elongate side edges 32, front edge 34, and rear edge 36, proximate to the periphery of the platform 18. The flange 38 is preferably adapted to assist in the stacking of a plurality of stairway platform devices 10 during periods of non-use (FIGS. 1 and 2). That is, the flange or rim 38 guides the side support walls 20 and front support wall 22 to allow one of the stairway platform 10 to stack onto the platform 18 of another of the stairway platforms 10.

A pair of side support walls 20 depend from the pair of substantially parallel and elongate side edges 32. The pair of side support walls 20 may be either integral or affixed to the platform 18 at the discretion of an individual. The pair of side support walls 20 may depend perpendicularly from the platform 18. In the preferred embodiment, the pair of side support walls 20 preferably depend, and flare outwardly from, the platform 18 in order to maximize the structural strength and stability of the stairway platform device 10. (FIGS. 1, 2, 6, 7, 8, and 9)

Each of the pair of side support walls 20 preferably includes a substantially vertical first edge 40 which is adjacent the rear support wall 24. In addition, each of the pair side support walls 20 preferably includes a substantially vertical second edge 42 which is preferably adjacent to the front support wall 22.

The substantially vertical first edges 40 may include a flange 38 which is adapted to assist in the stacking of a plurality of stairway platform devices 10 during periods of non-use. It should be noted that the flange 38 of the substantially vertical first edges 40 may extend either the entire length or a portion of the substantially vertical first edges 40 at the discretion of an individual.

Each of the pair of side support walls 20 preferably includes a plurality of substantially horizontal step engagement edges 44 and a plurality of substantially vertical riser engagement edges 46.

Each of the plurality of substantially horizontal step engagement edges 44 may include a corrugated non-slip surface at the preference of an individual which is adapted to minimize slippage of the stairway platform device 10 following positioning upon the stairs 12 of a building.

Each of the plurality of substantially vertical riser engagement edges 46 preferably depend and flare forwardly from either the platform 18 or from a vertically adjacent step engagement edge 44. Each of the plurality of substantially vertical riser engagement edges 46 are preferably designed for close fitting engagement to the riser surfaces 16 of the stairs 12 (FIGS. 2, 6, 7, and 9).

The outward flaring of the side support walls 20 and the forward flaring of the plurality of substantially vertical riser engagement edges 46 maximize the structural strength and stability of the stairway platform device 10 and facilitate the engagement of the invention to the stairs 12 of a dwelling.

The pair of side support walls 20 may flare outwardly from the platform 18 at any suitable angle as desired by an individual and may preferably have an angle relative to the platform of between 5° and 8°. An angle of 5° to 8° between the pair of side support walls 20 and the platform 18 facilitate and assist in preventing the inadvertent collapse of the stairway platform device 10 during use. In addition, the angle between the platform 18 and the pair of side support walls 20 facilitate the retention of the stairway platform device 10 in a desired position during use by an individual in conjunction with a ladder 26. It should be noted that the pair of side support walls 20 may depend perpendicularly from the platform 18 at the discretion of an individual.

Preferably, the stairway platform device 10 will be positioned adjacent to a wall 50 or the to the rungs of a stairway railing during use of the stairway platform device 10 with a ladder 26. In addition, the base of the ladder 26 will preferably be positioned adjacent to the wall 50 or rungs of a stairway railing in order to prevent the lateral slippage or rolling of the stairway platform device 10 from a desired position as placed upon the stairs 12 of a dwelling.

During use of the stairway platform device 10 upon a wider set of stairs 12, the stairway platform may be centrally positioned upon the horizontal surfaces 14 at the preference of an individual. If additional security against non-slippage is desired, an individual may utilize a rod or other suitable brace for positioning between the stairway platform device 10 and the wall 50 or rungs of the stairway 12. The engagement of the rod or brace to both the stairway platform device 10 and the wall 50 preferably prevents slippage of the stairway platform device 10. It should be noted that the rod may be of one or multiple pieces, telescoping, retractable, and/or lockable at the preference of an individual. In addition, the brace may be formed of a desired length of two-by-four wood or a dowel rod at the preference of an individual and is not limited to the embodiments described herein.

The outward flaring of the pair of side support walls 20 from the platform 18 assists in maintaining the weight of an individual or ladder centrally over the stairs 12 of a dwelling during use of the stairway platform device 10.

The pair of side support walls 20 may preferably be substantially solid and may be formed of the same material as selected for the stairway platform device 10. The stairway platform device 10 preferably includes at least three horizontal step engagement edges 44 and at least three vertical riser engagement edges 46. However, the stairway platform device 10 may include two or four horizontal step engagement edges 44 and vertical riser engagement edges 46 at the preference of an individual.

The front support wall 22 may depend from the platform 18 proximate to the front edge 34. The front support wall 22 may also preferably flare forwardly to conform to the angular offset between the horizontal surface 14 and the riser surface 16 of the stairs 12. Preferably, the riser engagement edges 46 are positioned in close engagement to the riser surfaces 16 during use of the stairway platform device 10. Alternatively, the front support wall 22 may depend vertically from, and be substantially perpendicular to, the platform 18 at the preference of an individual.

Figure 11:
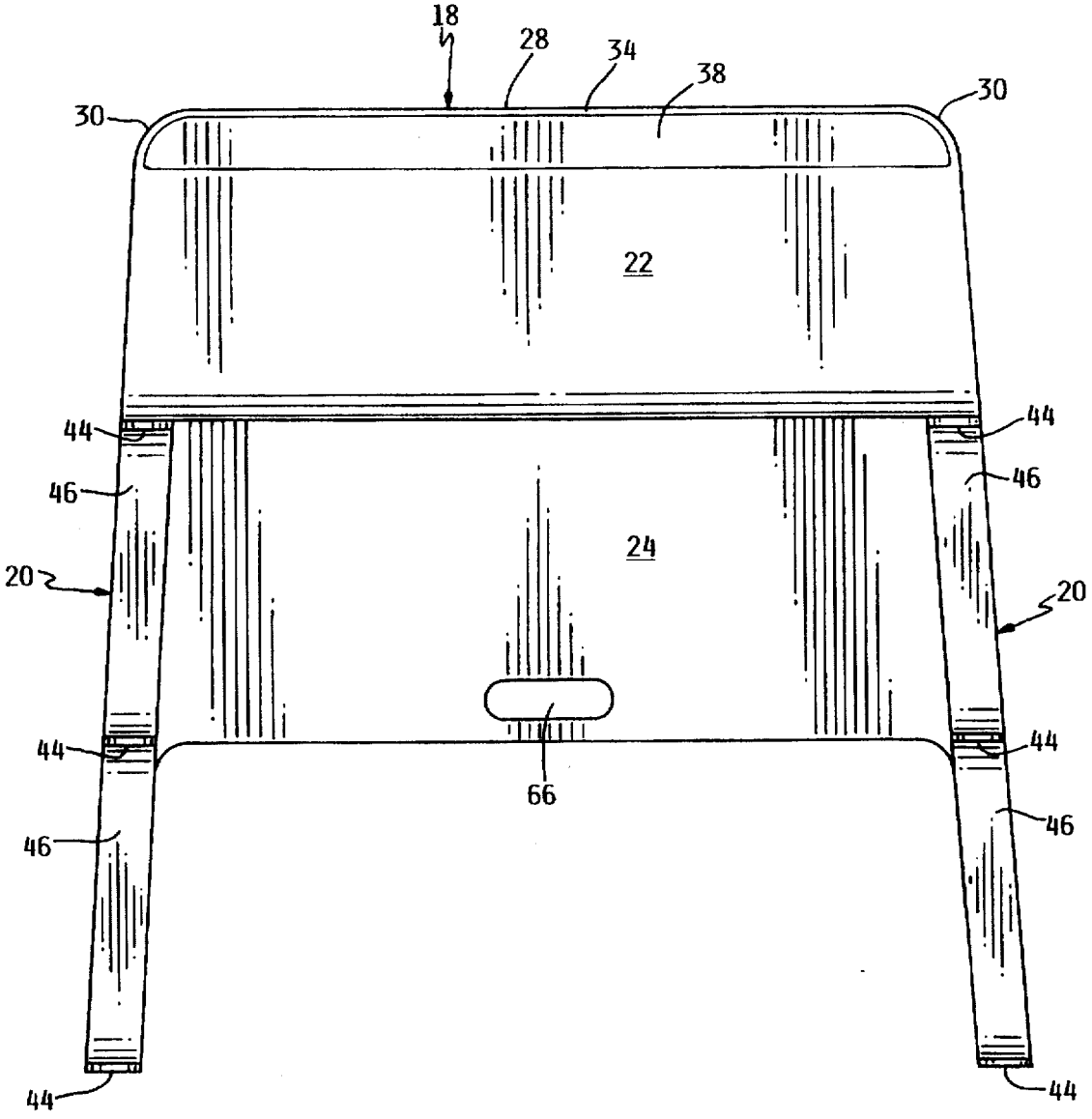
FIG. 11 is a front view of the stairway platform device.

The forward flaring of the front support wall 22 from the platform 18 assists in maximizing the structural strength and stability of the stairway platform device 10. Additionally, the forward flaring of the front support wall 22 assists in the stacking of a plurality of stairway platform devices 10 during periods of non-use by engaging a flange 38 (FIG. 11).

The front support wall 22 may be integral or affixed to the platform 18 as previously described for the pair of side support walls 20 and may be formed of the same material as selected for the platform 18 and the pair of side support walls 20.

The front support wall 22 may also include a substantially horizontal and longitudinally extending flange 38 proximate or integral to the front edge 34. This flange 38 is also adapted to assist in the stacking of a plurality of stairway platform devices 10 during periods of non-use. Additionally, the front support wall 22 may include a substantially vertical flange 38 integral or proximate to each of the substantially vertical second edges 42. These flanges 38 are also adapted to assist in the stacking of a plurality of stairway platform devices 10 during periods of non-use.

Figure 14:
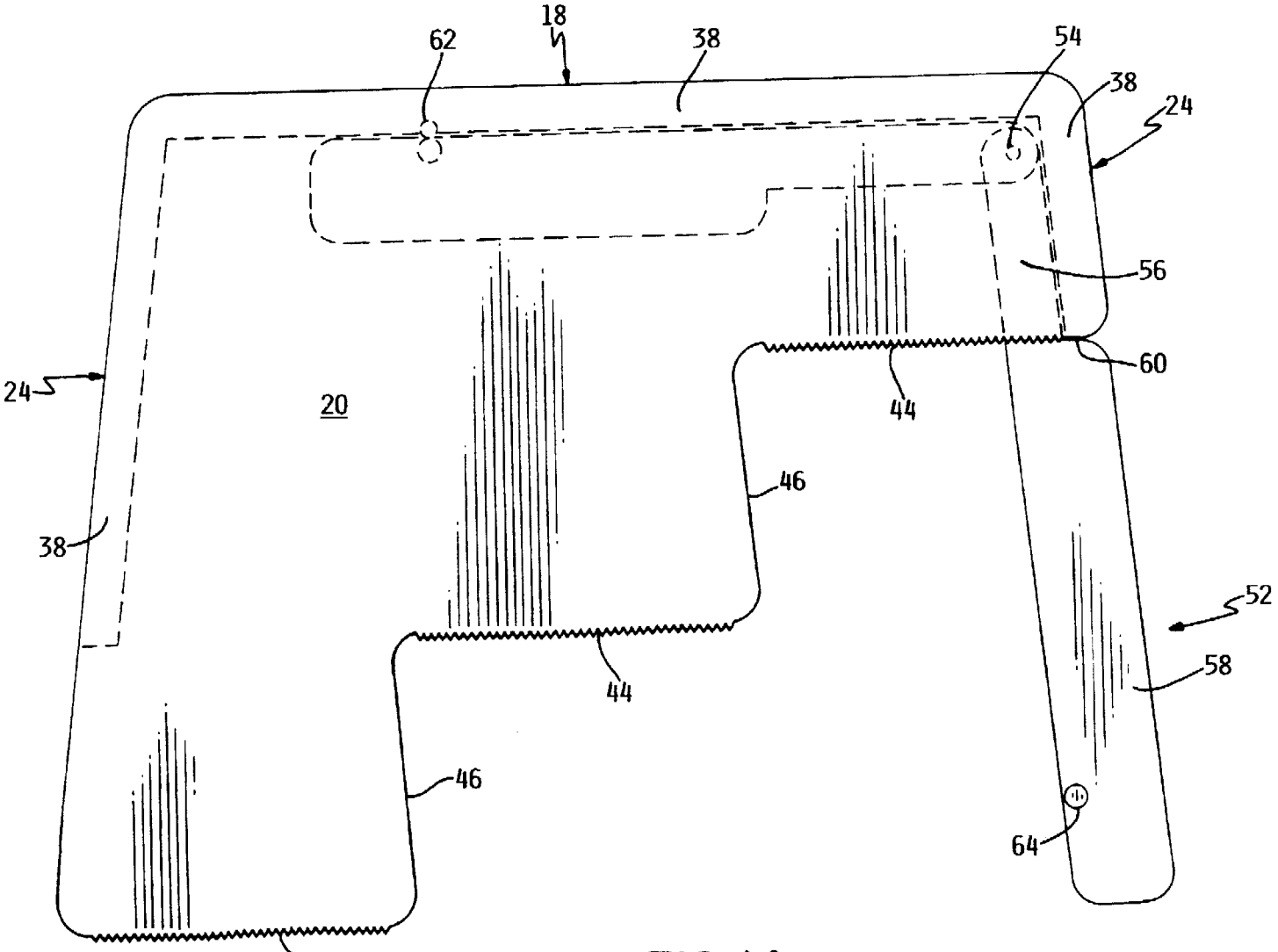
FIG. 14 is an alternative side view of the stairway platform device showing the tuck-under leg.
Figure 15:
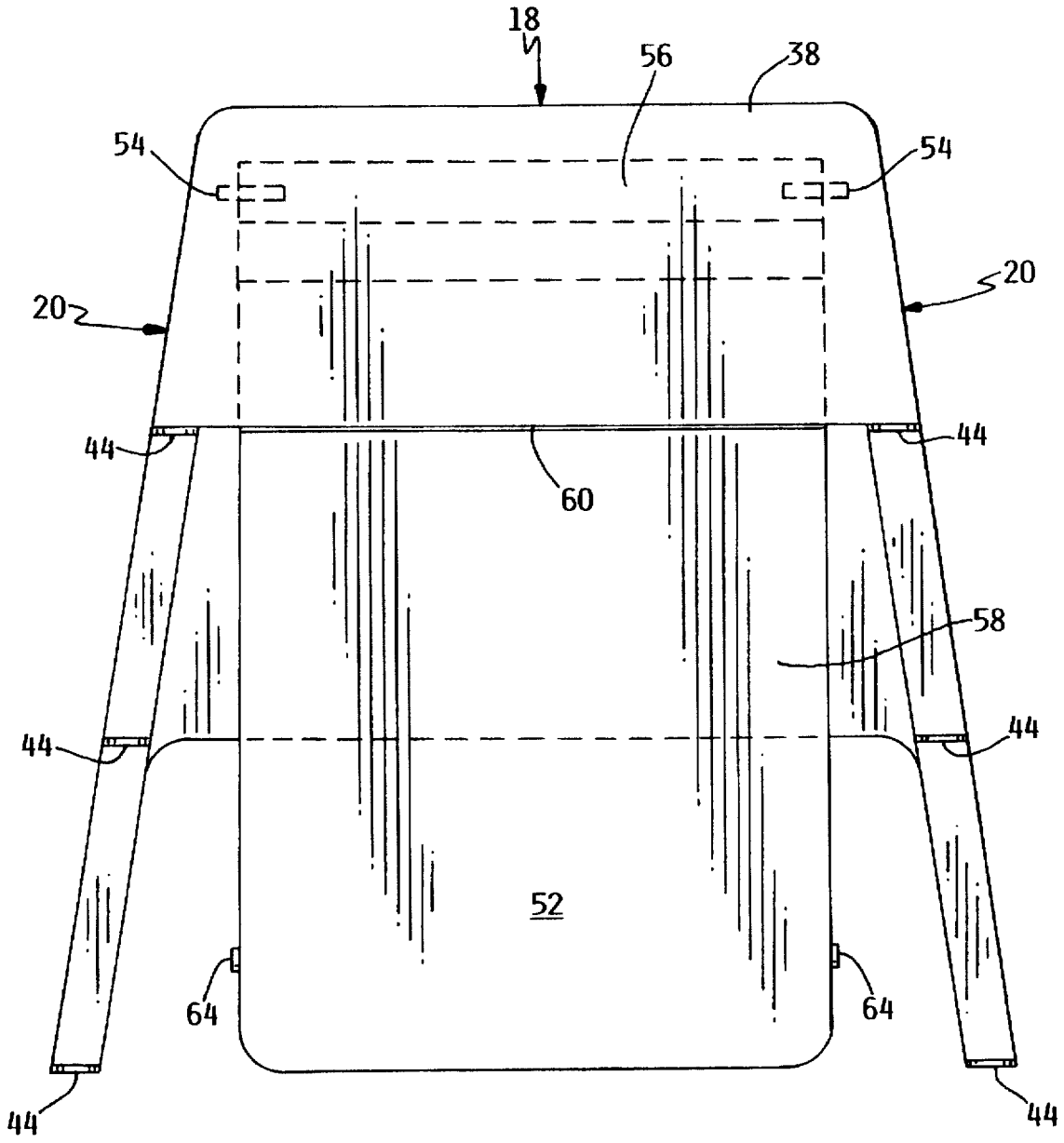
FIG. 15 is a partial phantom line front view of the stairway platform device showing the tuck-under leg in an operative position.

As may be seen in FIGS. 14 and 15, the stairway platform device 10 may include a tuck-under leg 52. The tuck-under leg 52 may be pivotably and retractably engaged to the front support wall 22 by a means for pivoting 54. The means for pivoting 54 may preferably be an elongate pin which may extend and be centrally positioned along the majority of the length dimension of the front edge 34. The elongate pin of the means for pivoting 54 may be any length as preferred by an individual. Alternatively, the means for pivoting 54 may be formed of bolts and nuts, screws, or pegs, at the discretion of an individual.

The means for pivoting 54 may be integral or affixed to the front support wall 22, proximate to both the front edge 34, and to the substantially vertical second edges 42, as preferred by an individual. Alternatively, the means for pivoting 54 may be integral or affixed to the front support wall 22 approximately equal distances between the substantially vertical second edges 42 proximate to the front edge 34. Alternatively, the means for pivoting may be integral or affixed to the pair of side support walls 20 proximate to the front edges 34.

In general, the tuck-under leg 52 includes a pivoting engagement section 56, a lower support section 58, and a means for positioning 60 which retains the tuck-under leg 52 in an operative position. It should be noted that both the tuck-under leg 52 and the front support wall 22 are preferably flared forwardly from the platform 18 to assist in maximizing the structural strength and stability of the stairway platform device 10 and the stacking of a plurality of stairway platform devices 10 during periods of non-use.

The tuck-under leg 52 may be a substantially integral one piece support or may be formed of two independently retractable leg members at the discretion of an individual.

The junction between the pivoting engagement section 56 and the lower support section 58 defines the area for the means for positioning 60. In the preferred embodiment, the means for positioning 60 may be a ledge which mates with the lower edge of the front support wall 22 during the pivotal placement of the tuck-under leg 52 in a forward operative position. It should be noted that in this embodiment the lower edge of the front support wall 22 functions as a stop preventing undesirable forward pivotal rotation of the tuck-under leg 52. Alternatively, the means for positioning 60 may be formed by stops or brackets which may be affixed to either or both the interior of the side support walls 20, the underside of the platform 18, and/or the pivoting engagement section 56 of the tuck-under leg 52. Alternatively, the interior surface of the front support wall 20 may function as a means for positioning 60 restricting forward pivotal rotation of the tuck-under leg 52 beyond a desired position.

The lower support section 58 of the tuck-under leg 52 preferably includes a means for retention 62 as depicted in FIG. 15. The means for retention 62 may be at least one extruded affixation tab 64, hooks, pins, or raised ribs or ledges as preferred by an individual. The means for retention 62 may also include a matching ledge, aperture, or tab integral or affixed to the underside of the platform 18, or to the interior upper surface of at least one of the side support walls 20.

The retractable tuck-under leg 52 is substantially the same length as the rear support wall and thereby allows the stairway platform device 10 to be used as a stool significantly improving the flexibility and utility of the stairway platform device 10. That is, the stairway platform device can provide a stable, level, stand-alone support in the absence of a stairway. The means for retention 62 allows the tuck-under leg 52 to be quickly, easily, and conveniently pivotably retracted within the interior of the stairway platform device 10 during storage, stacking, or periods of non-use.

The rear support wall 24 may depend from the platform 18 proximate to the rear edge 36. The rear support wall 24 may also preferably flare rearwardly to conform to the angular offset of the substantially vertical first edges 40. Alternatively, the rear support wall 24 may depend vertically from and be substantially perpendicular to, the platform 18 at the preference of an individual.

Figure 8:
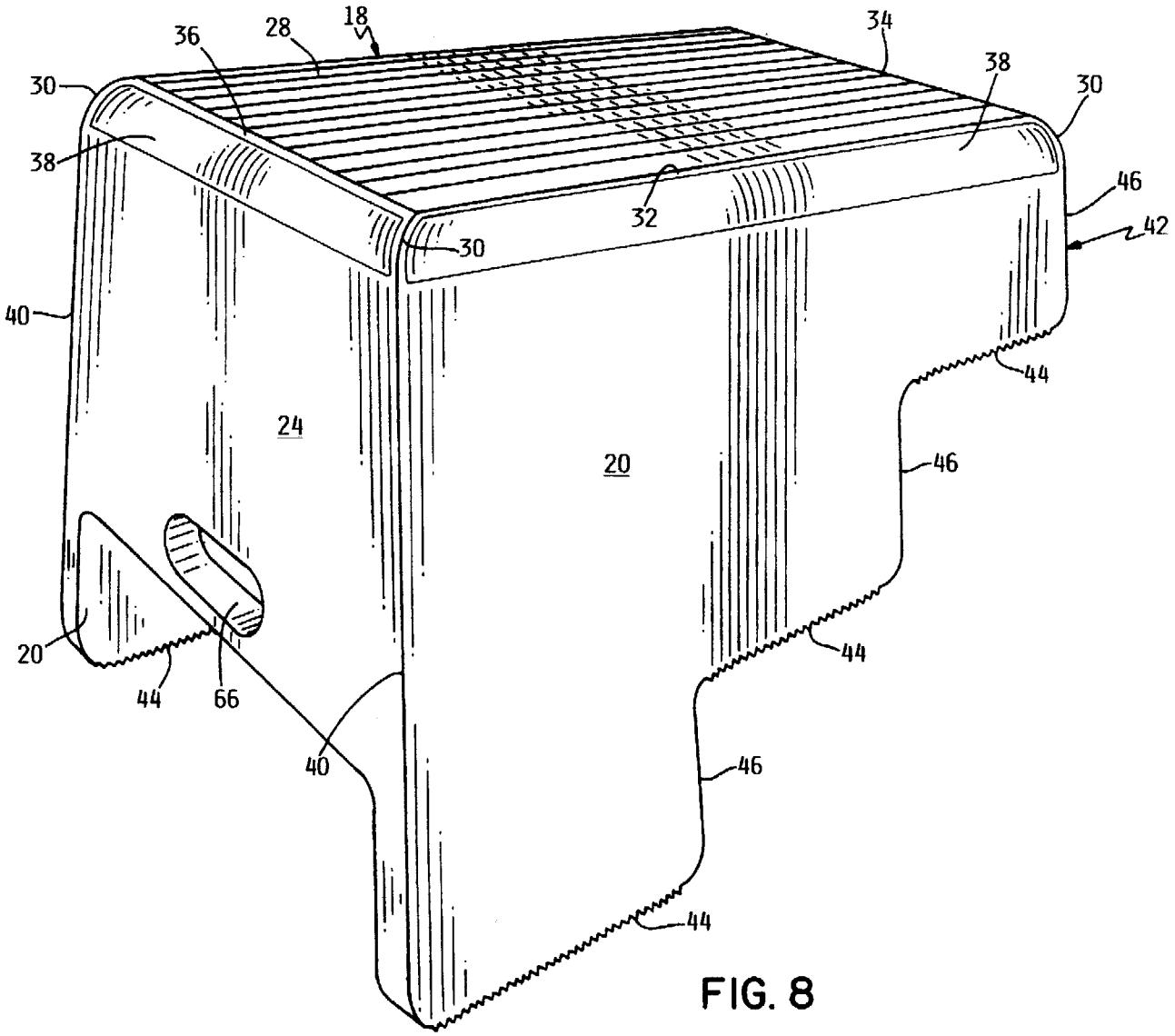
FIG. 8 is an isometric view of the stairway platform device.
Figure 9:
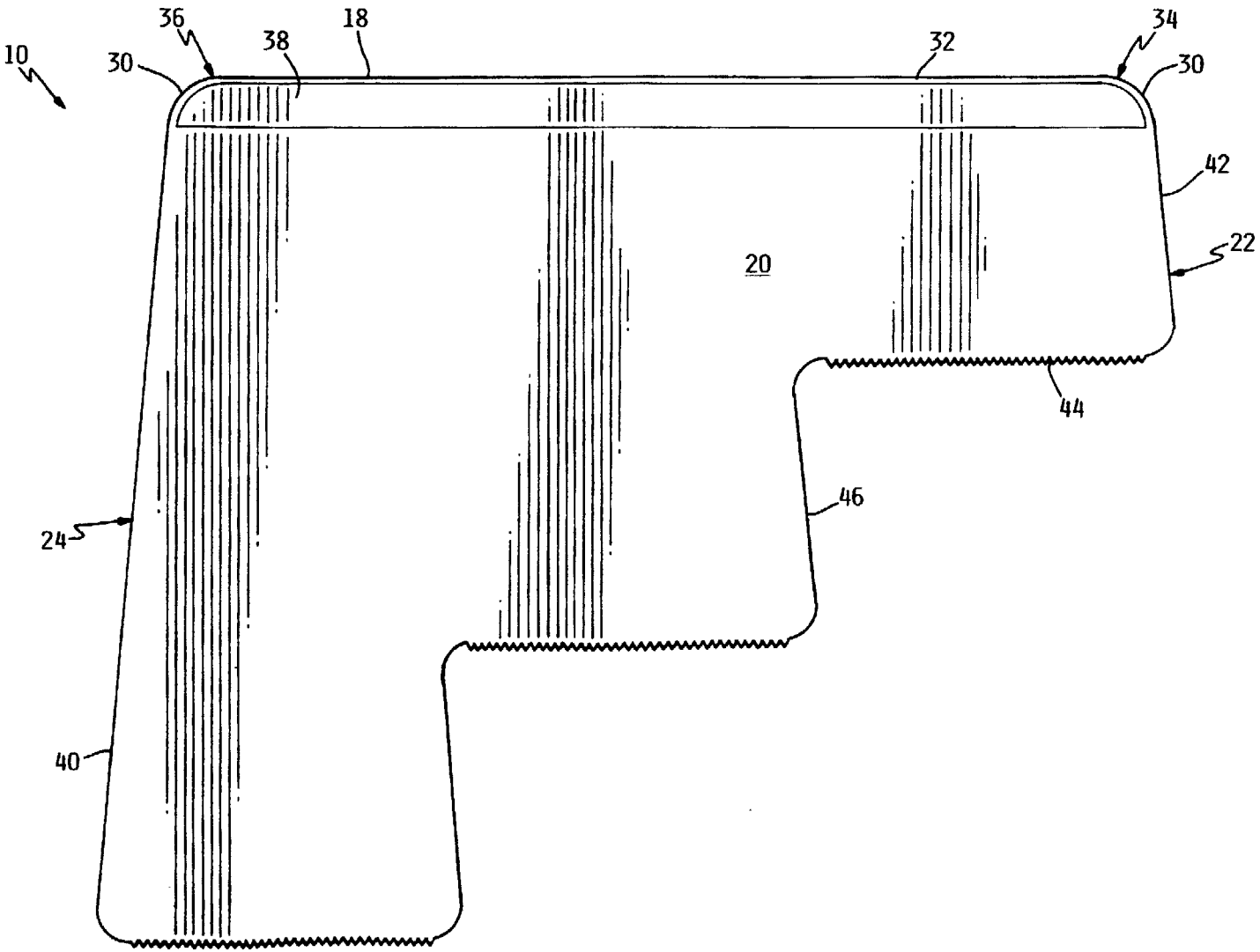
FIG. 9 is a side view of the stairway platform device.
Figure 10:
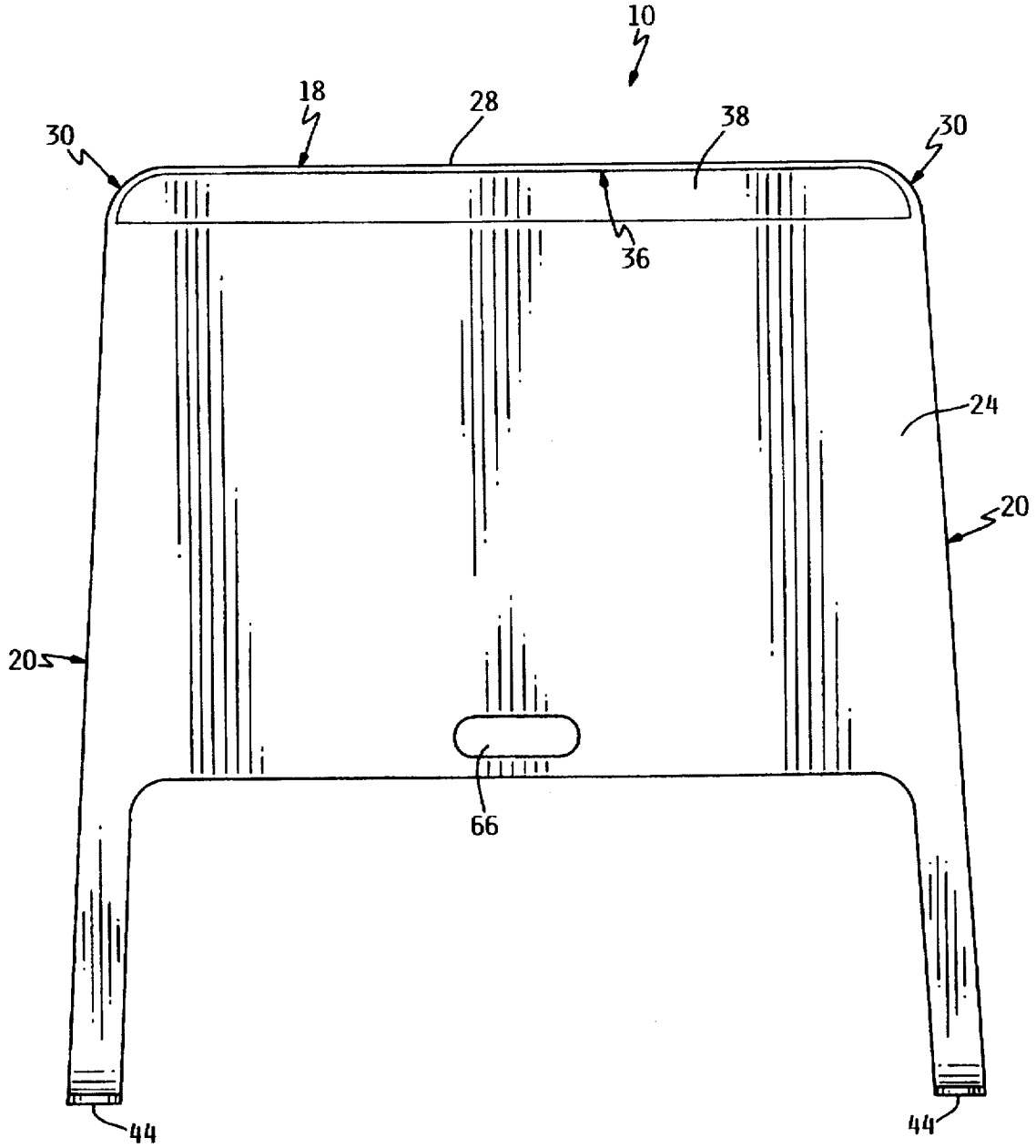
FIG. 10 is a rear view of the stairway platform device.

The rearward flaring of the rear support wall 24 assists in maximizing the structural strength and stability of the stairway platform device 10. Additionally, the rearward flaring of the rear support wall 24 assists in the stacking of a plurality of stairway platform devices 10 during periods of non-use by engaging a flange 38 (FIG. 8).

The rear support wall 24 may be integral or affixed to the platform 18 and pair of side support walls 20 as previously described for the pair of side support walls 20, and the front support wall 22. The rear support wall 24 may be formed of the same material as selected for the platform 18, the pair of side support walls 20, and the front support wall 22 as earlier described.

The rear support wall 24 may also include a substantially horizontal and longitudinally extending flange 38 which also is adapted to assist in the stacking of a plurality of stairway platform devices 10 during periods of non-use. Additionally, the rear support wall 24 may include a substantially vertical flange 38 proximate or integral to each of the substantially vertical first edges 40. These flanges 38 are also adapted to assist in the stacking of a plurality of stairway platform devices 10 during periods of non-use.

The rear support wall 24 may include a transportation handle 66 which may be centrally positioned between the pair of side support walls 20. The rear support wall 24 may also include a cutaway area below the handle 66.

The rear support wall 24 may also include a storage compartment 68 which may be used by an individual for transportation of painting and/or wallpapering tools. Access to the storage compartment 68 may be achieved through a door 70. The door 70 is engaged to the rear support wall 24 by a means for opening 72 and the door 70 may be retained in a closed position by a means for affixation 74.

The means for opening 72 may include, but is not limited to, the use of hinges, pins, or tabs at the discretion of an individual. The means for affixation 74 may include, but is not limited to, the use of a hasp, tabs, or a snap latch.

The storage compartment 68 is preferably centrally positioned with respect to the rear support wall 24 and is positioned internally below the platform 18 and between the pair of side support walls 20. The storage compartment 68 may be integral or affixed to the rear support wall 24 and/or the pair of side support walls 20 and/or the platform 18 at the discretion of an individual. In addition, the storage compartment 68 may also be releasably attached to the interior of the stairway platform device 10 as desired by an individual. The storage compartment 68 may have length, width, and depth dimensions approximating ten inches in size or may be suitably larger or smaller in size, as desired by an individual.

In the alternative embodiment, the storage compartment 68 may be accessible by the pivotable lifting or vertical separation of the platform 18 from the stairway platform device 10. In this embodiment, the means for opening 72 and/or means for affixation 74 may be applied to either the elongate side edges 32, the front edge 34, or to the rear edge 36 at the discretion of an individual. Alternatively, the pair of side support walls 20, front support wall 22, and rear support wall 24 may include an internal guide rim, flange, or wall which may be utilized to engage the interior of the platform 18 for assisting in the guidance of the platform 18 vertically upon the stairway platform device 10.

During use of the stairway platform device 10, the horizontal step engagement edges 44 and the vertical riser engagement edges 46 are preferably placed forwardly proximate to the riser surfaces 16 to maximize engagement of the horizontal step engagement edges 44 to the horizontal surfaces 14 of the stairs 12. An individual may then stand or position a ladder upon the platform 18 proximate to the front edge 34 to achieve maximum stability of the stairway platform device 10 during use. A stairway platform device 10 positioned in the above-described manner additionally maximizes the engagement of the corrugated surfaces of the horizontal step engagement edges 44 to the horizontal surfaces 14, thereby minimizing slippage of the stairway platform device 10 during use.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A stairway platform device comprising:

(a) a platform having a substantially flat horizontal surface comprising a slip resistant surface;

(b) a pair of side support walls depending from said platform, each of said pair of side support walls comprising a plurality of substantially horizontal step engagement edges and substantially vertical riser engagement edges, each of said side support walls being adapted to maximize structural strength and stability of said stairway platform device when engaged to the steps of a stairway, each of said side support walls further comprising a substantially vertical first edge and second edge;

(c) a front support wall depending from said platform;

(d) a rear support wall depending from said platform opposite to said front support wall; said front support wall depending and flaring forwardly from said platform; said rear support wall depending and flaring rearwardly from said platform; and (e) a means for pivoting position proximate to said from support wall, a retractable and pivotable tuck-under leg engaged to said means for pivoting, a means for positioning said tuck-under leg in an operative position, and a means for retention of said tuck-under leg in a retracted storage position, said tuck-under leg being of substantially the same length as said rear support wall as to allow the stairway platform device to be used as a stool in the absence of a stairway.

2. The stairway platform device according to claim 1, said platform further comprising a pair of elongate side edges, a front edge, and a rear edge.

3. The stairway platform device according to claim 2, said slip resistant surface comprising a plurality of ribs.

4. The stairway platform device according to claim 3, said platform further comprising a plurality of rounded corners.

5. The stairway platform device according to claim 1, said step engagement edges comprising a corrugated surface adapted to minimize slippage when positioned on said steps of a stairway.

6. The stairway platform device according to claim 1, wherein said riser engagement edges depend and flare forwardly from said platform.

7. The stairway platform device according to claim 1, wherein said pair of side support walls are integral to said platform.

8. The stairway platform device according to claim 1, wherein said pair of side support walls are affixed to said platform.

9. The stairway platform device according to claim 1, wherein said front support wall is integral to said platform and to said pair of side support walls.

10. The stairway platform device according to claim 1, wherein said front support wall is affixed to said platform and to said pair of side support walls.

11. The stairway platform device according to claim 1, said means for pivoting comprising an elongate pin.

12. The stairway platform device according to claim 1, said means for positioning comprising a ledge.

13. The stairway platform device according to claim 1, said means for retention comprising at least one tab affixed to said platform.

14. The stairway platform device according to claim 1, said means for retention comprising at least one tab affixed to one of said side support walls.

15. The stairway platform device according to claim 1, wherein said rear support wall is integral to said platform and to said pair of side support walls.

16. The stairway platform device according to claim 1, wherein said rear support wall is affixed to said platform and to said pair of side support walls.

17. The stairway platform device according to claim 1, said rear support wall further comprising a handle.

18. The stairway platform device according to claim 1, said rear support wall comprising a means for opening, a door engaged to said means for opening, and a storage compartment positioned adjacent to said door and forwardly of said rear support wall internally between said pair of side support walls.

19. The stairway platform device according to claim 18, said means for opening comprising at least one pin.

20. The stairway platform device according to claim 18 further comprising a means for affixation of said door in a closed position.

21. A stairway platform device comprising:

(a) a platform having a pair of elongate side edges, a front edge, and a rear edge defining a periphery about said pair of elongate side, front, and rear edges, a substantially flat horizontal surface comprising a slip resistant surface, and a plurality of rounded corners;

(b) a pair of side support walls depending and flaring outwardly from said pair of elongate side edges, each of said pair of side support walls comprising a substantially vertical first edge and second edge, each of said pair of side support walls further comprising a plurality of substantially horizontal step engagement edges and substantially vertical riser engagement edges, each of said step engagement edges comprising a corrugated surface adapted to minimize slippage when positioned upon a stairway step, each of said riser engagement edges depending and flaring forwardly from said platform each of said side support walls being adapted to maximize structural strength and stability of said stairway platform device when engaged to said stairway steps;

(c) a front support wall depending and flaring forwardly from said platform proximate to said front edge;

(d) a rear support wall depending and flaring rearwardly from said platform proximate to said rear edge, said rear support wall comprising a handle, said rear support wall further comprising a means for opening, a door engaged to said means for opening, and a storage compartment positioned adjacent said door and forwardly of said rear support wall internally between said pair of side support walls; and (e) a means for pivoting attached proximate to said front support wall, a retractable and pivotable tuck-under leg engaged to said means for pivoting, a means for positioning said tuck-under leg in an operative position, and a means for retention of said tuck-under leg in a retracted storage position, said tuck-under-leg being of substantially the same length as said rear support wall as to allow the stairway platform device to be used as a stool in the absence of a stairway.

* * * * *